US005391446A

United States Patent [19]

Ohtani et al.

[11] Patent Number: 5,391,446

[45] Date of Patent: Feb. 21, 1995

[54] IMAGE HOLDING MEMBER

[75] Inventors: Noriko Ohtani, Yokohama; Akio Maruyama; Shin Nagahara, both of Tokyo; Shinya Mayama, Yamato, all of Japan

[73] Assignee: Canon Kabushiki Kaisha, Tokyo, Japan

[21] Appl. No.: 103,033

[22] Filed: Jul. 2, 1991

[30] Foreign Application Priority Data

| | | | |
|---|---|---|---|
| Jul. 2, 1990 | [JP] | Japan | 2-175843 |
| Aug. 3, 1990 | [JP] | Japan | 2-206603 |
| Aug. 3, 1990 | [JP] | Japan | 2-206611 |
| Aug. 3, 1990 | [JP] | Japan | 2-206618 |

[51] Int. Cl.[6] ..... G03G 5/147; G03G 5/047

[52] U.S. Cl. ..... 430/58; 430/66; 430/67

[58] Field of Search ..... 430/66, 67, 96, 905, 430/64, 58

[56] References Cited

U.S. PATENT DOCUMENTS

| | | | |
|---|---|---|---|
| 4,728,592 | 3/1988 | Ohaku et al. | 430/59 |
| 4,948,720 | 8/1990 | 90Chen et al. | 430/527 |
| 5,004,663 | 4/1991 | Badesha et al. | 430/59 |
| 5,008,169 | 4/1991 | Yu et al. | 430/59 |
| 5,051,295 | 9/1991 | Mori et al. | 428/195 |
| 5,082,717 | 1/1992 | Yaguchi et al. | 428/207 |

FOREIGN PATENT DOCUMENTS

| | | |
|---|---|---|
| 0443626 | 8/1991 | European Pat. Off. . |
| 60-55355 | 3/1985 | Japan . |
| 60-55356 | 3/1985 | Japan . |
| 61-5253 | 1/1986 | Japan . |
| 61-239248 | 10/1986 | Japan . |
| 63-48564 | 3/1988 | Japan . |
| 3065390 | 3/1991 | Japan . |

OTHER PUBLICATIONS

Patent Abstracts of Japan vol. 13, No. 284(P.892)(3632), Jul. 29, 1989.

Patent Abstracts of Japan, vol. 13, No. 284(P.966)(3878), Nov. 27, 1989.

Patent Abstracts of Japan, vol. 13, No. 467(P.948)(3815), Oct. 23, 1989.

*Primary Examiner*—Roland Martin

*Attorney, Agent, or Firm*—Fitzpatrick, Cella, Harper & Scinto

[57] ABSTRACT

An image holding member rich in durability and suitably used as an electrophotographic photosensitive member or an electrostatic image-holding dielectric member is prepared by coating a support with a resinous layer formed by polymerization of a phosphazene polyene represented by the following formida:

(I)

wherein $R_1$ denotes an ethylenically unsaturated group, preferably an acrylic group represented by $—R_2—OCO—C(R_3)=CH_2$, wherein $R_2$ denotes an alkylene group, arylene group, alkyl-substituted arylene group, alkylamide group or arylamide group, and $R_3$ denotes a hydrogen atom or a methyl group. The resinous layer may constitute a photosensitive layer, a dielectric layer, or a protective layer covering these layers.

22 Claims, 1 Drawing Sheet

IMAGE HOLDING MEMBER

FIELD OF THE INVENTION AND RELATED ART

The present invention relates to an image holding member for holding an electrostatic image thereon, more particularly such an image holding member having an improved resinous protective layer.

Image holding members may be roughly classified into a type having a photosensitive layer and a type having a dielectric layer instead of a photosensitive layer.

The former type includes a so-called electrophotographic photosensitive member, and examples of the latter type include the following:

(1) An image holding member used in an electrophotographic process wherein an electrostatic image formed on an electrophotographic photosensitive member is once transferred onto the image holding member having no photosensitive layer and developed thereon, and the developed image is again transferred to a recording medium or a transfer-receiving material, so as to alleviate the durability of the electrophotographic photosensitive member for repetitive use, as disclosed in Japanese Patent Publications Nos. 7115/1957, 8204/1957 and 1559/1968.

(2) An image holding member used in an image-forming process wherein an electrostatic image is formed on an electrophotographic photosensitive member in the form of a screen having a large number of perforations, the image holding member having no photosensitive layer is subjected to corona charging through the electrostatic image causing a modulation of a corona ion stream to form an electrostatic image on the image holding member, and then the electrostatic image is developed with a toner to form a toner image, which is then transferred onto a recording medium to form a final image thereon, as disclosed in Japanese Patent Publications Nos. 30320/1970, 5063/1973 and Japanese Laid-Open Patent Application No. 341/1976 (i.e., JP-A 51-341).

(3) An image holding member used in an electrophotographic process wherein a toner image formed on an electrophotographic photosensitive member or another image holding member having no photosensitive layer is once transferred to the image holding member having no photosensitive layer and then further transferred to a recording medium. This process is particularly effective, e.g., in formation of a multi-color image. A recording medium is generally composed of paper or film which is rich in flexibility, so that it is easier to form a multi-color image in accurate positional alignment if respective color images are transferred onto an image holding member formed of a material which is substantially free from deformation and the transferred respective color images are again simultaneously transferred to a recording medium instead of transferring such respective color images successively to a recording medium with an accurate positional alignment.

(4) An image holding member used in an electrophotographic process wherein the image holding member having no photosensitive layer is supplied with electric signals through multi-stylus electrodes to form an electrostatic image thereon depending on the electric signals, which electrostatic image is developed and then transferred to form an image.

Such image holding members are generally repeatedly used, so that they are required to show durability against various external forces inclusive of electrical and mechanical forces.

For example, an electrophotographic photosensitive member is not only required to show a prescribed sensitivity, an electrical property and a photographic property corresponding to an electrophotographic process using the photosensitive member but is also required to be durable against electrical and mechanical external forces, such as those encountered in corona charging, development with a toner, transfer to paper, and in a cleaning operation to which the photosensitive member is directly and repeatedly subjected. More specifically, an electrophotographic photosensitive member is required to show durabilities against degradation with ozone or $NO_x$ generated at the time of corona charging so as not to cause a decrease in sensitivity, a potential decrease or an increase in remanent potential and also against surface abrasion or occurrence of mars or scars.

Various resins have been studied so as to satisfy these requirements of image holding members, inclusive of photosensitive layers and dielectric layers.

It has been also proposed to dispose a resinous protective layer on the surface of image holding members by Japanese Laid-Open Patent Applications (JP-A) 60-55355 and 60-55356. Further, JP-A 63-48564 has proposed an electrophotographic photosensitive member having a protective layer comprising a photocured resin, and JP-A 61-5253 has proposed an electrophotographic photosensitive member having a surface layer comprising a thermoset resin. Furthermore, JP-A 57-30843 has proposed to control the resistivity of a protective layer by inclusion of electroconductive powder of iron oxide.

On the other hand, an electrophotographic photosensitive member is required to exhibit a good cleaning performance of the surface layer so as to solve a problem of toner attachment onto the surface thereof during repetitive development with a toner and cleaning of the residual toner.

In view of requirements of a further improved image quality in recent years, an image holding member satisfying the above-mentioned requirements at higher levels is still desired.

SUMMARY OF THE INVENTION

An object of the present invention is to provide an image holding member which is excellent in durability and lubricity and is also capable of providing high-quality images free of defects even on repetitive use.

According to the present invention, there is provided an image holding member, comprising: a support and a resinous layer disposed on the support, the resinous layer comprising a resin formed by polymerization of a compound represented by the following Formula (I):

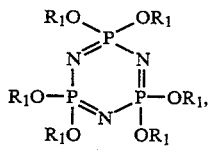

(I)

wherein $R_1$ denotes an ethylenically unsaturated group.

According to another aspect of the present invention, there are also provided an electrophotographic apparatus, an electrophotographic device unit and a facsimile apparatus including such an image holding member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
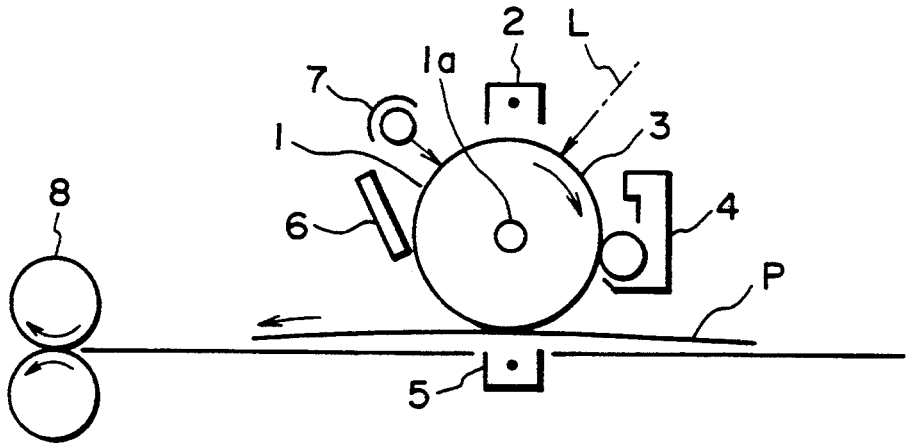
FIG. 1 is a schematic view illustrating the outline of an electrophotographic apparatus equipped with an electrophotographic photosensitive member according to the present invention.

The image holding member is characterized by having a resinous layer comprising a resin formed by polymerization of a compound represented by the above Formula (I). The compound is hereinafter sometimes referred to as a "phosphazene polyene".

The resin formed by polymerization of a phosphazene polyene represented by the above Formula (I) (hereinafter sometimes referred to as "phosphazene polyene resin"), shows excellent performances, with respect to e.g., transparency, rigidity, strength, wear resistance, adhesiveness, surface smoothness and lubricity, and shows particularly excellent performance when $R_1$ in Formula (I) is an ethylenically unsaturated group (i.e., a group having an ethylenic unsaturation) represented by the following formula (II):

$$-R_2-O-\overset{\overset{\displaystyle O}{\|}}{C}-\overset{\overset{\displaystyle R_3}{|}}{C}=CH_2, \qquad \text{(II)}$$

wherein $R_2$ denotes an alkylene group, arylene group, alkyl-substituted arylene group, alkylamide group or arylamide group, and $R_3$ denotes a hydrogen atom or a methyl group.

The phosphazene polyene represented by Formula (I) may for example be prepared through the following reaction scheme:

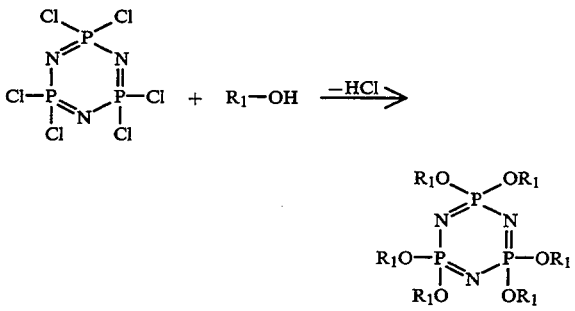

Non-exhaustive examples of the hydroxy compound $R_1$-OH may include: 2-hydroxyethyl acrylate, 2-hydroxyethyl methacrylate, 2-hydroxypropyl acrylate, 2-hydroxypropyl methacrylate, 1,3-butanediol monoacrylate, 1,3-butanediol monomethacrylate, 1,4-butanediol monoacrylate, 1,4-butanediol monomethacrylate, 1,6-hexanediol monoacrylate, 2-hydroxy-3-phenoxypropyl acrylate, 2-hydroxy-3-phenoxypropyl methacrylate, pentaerythritol monoacrylate, pentaerythritol monomethacrylate, pentaerythritol diacrylate, pentaerythritol dimethacrylate, pentaerythritol triacrylate, pentaerythritol trimethacrylate, 1,3-bis(3″-acryloxyethoxy-2′-hydroxypropyl)-5,5-dimethylhydantoin, 1,3-bis(3″-methacryloxyethoxy-2′-hydroxypropyl)-5,5-dimethylhydantoin, bisphenol A-diglycidyl-ether diacrylate, bisphenol A-diglycidyl-ether methacrylate, N-methylolacrylamide, and N-methylmethacrylamide.

In the present invention, the phosphazene polyene represented by Formula (I) may be used singly to form a resin or in mixture of two or more species to form a copolymer resin. It is also possible to mix the phosphazene polyene with another ethylenically unsaturated monomer, preferably another (meth)acrylate monomer, further preferably another poly-(meth)acrylate monomer, to form a copolymer resin. Thus, the term "polymerization" is used herein to cover "copolymerization". In any case, the phosphazene polyene should preferably be used in a proportion of at least 20 wt. %, particularly at least 30 wt. %, of the total monomer.

Further, the phosphazene polyene can be used in mixture with another resin. Examples of such another resin may include: polyester, polycarbonate, polyvinyl chloride, cellulose resin, fluorine-containing resin, polyethylene, polyurethane, acrylic resin, epoxy resin, silicone resin, alkyd resin and various copolymers, such as vinyl chloride-vinyl acetate copolymer resin, etc. In such a mixture, the phosphazene polyene of the present invention may be used in an amount constituting at least 5 wt. %, preferably at least 10 wt. %, further preferably at least 20 wt. %, still further preferably at least 30 wt. %, of the total of the phosphazene polyene and the resin constituting the resinous layer.

The resinous layer according to the present invention may be formed by applying a paint comprising a phosphazene polyene as described above, an appropriate solvent and an optional ingredient, if any, corresponding to the use of the resinous layer, onto a substrate or by the medium of an intermediate layer, followed by drying and curing on exposure to light or heat. The light used for curing may be actinic radiation including ultraviolet rays, X-rays, and an electron beam. When the resinous layer is cured by exposure to light, the paint composition therefor may preferably contain a photoinitiator. The photoinitiator may be any one which can generate radicals on exposure to such actinic radiations, and examples thereof may include photoinitiators of acetophenone-type, benzoin-type, benzophenone-type and thioxanthone-type generally used. The photoinitiator may be added in a proportion of 0.1 to 50 wt. %, preferably 0.5 to 30 wt. %, of the monomer.

When the resinous layer according to the present invention is used as a dielectric layer, the dielectric layer may be formed by applying a coating liquid comprising the phosphazene polyene, optionally another resin and a solvent followed by drying and curing of the coating layer to form a dielectric layer.

Such another resin used together with the resin of the phosphazene polyene to constitute the dielectric layer may be a resin ordinarily constituting a dielectric layer, examples of which may include: polyester resin, phenoxy resin, styrene resin, vinyl chloride resin, cellulose resin, vinyl acetate resin, vinyl chloride-vinyl acetate copolymer resin, vinyl acetate-(meth)acrylate copolymer resin, and thermoplastic urethane resin. The resin from the phosphazene polyene may preferably constitute at least 20 wt. %, particularly at least 30 wt. %, of the total resin component.

Hereinbelow, the present invention will be explained in more detail with reference to an electrophotographic photosensitive member as an embodiment of the image holding member.

The resin formed by polymerization of the phosphazene polyene according to the present invention is provided with a three-dimensional network structure showing an excellent mechanical strength.

Further, the phosphazene polyene used in the present invention has a very high sensitivity in photopolymerization, so that the amount of the photoinitiator to be used can be minimized and curing is performed at a small irradiation dose. As a result, it is possible to alleviate a conventional problem of degradation of electrophotographic performance due to reaction of polymerization-initiating radicals with a charge-generating substance or a charge-transporting substance, or due to deterioration of the charge-generating substance or charge-transporting substance.

The electrophotographic photosensitive member according to the present invention may assume roughly two types of structures including a first type wherein the resin of the polymerized phosphazene polyene is used as a binder of a photosensitive layer and a second type wherein the resin constitutes a protective layer on the photosensitive layer.

The first type is explained first.

The photosensitive layer of the first type of electrophotographic photosensitive member according to the present invention may assume either a so-called single layer structure wherein both a charge-generating substance and a charge-transporting substance are contained in a single layer, or a so-called laminate structure including a charge generation layer comprising a charge-generating substance and a charge transport layer comprising a charge-transporting substance. In case of the laminate structure, it is preferred to dispose the charge generation layer and the charge transport layer in this order on an electroconductive support in this embodiment.

Examples of the charge-generating substance may include: pyrylium dyes, thiopyrylium dyes, phthalocyanine pigments, anthranthrone pigments, dibenzpyrenequinone pigments, trisazo pigments, disazo pigments, azo pigments, and indigo pigments. Such a charge-generating substance is not so strong in film-forming ability as to form a layer by itself and is generally dispersed together with a binder resin in an appropriate solvent to form a coating liquid. However, it is also possible to form a charge generation layer by vapor deposition of such a charge-generating substance without a binder resin Examples of the binder resin used for the above purpose may include: polyvinyl butyral, polystyrene, acrylic resin and polyester.

In case where the phosphazene polyene is used for constituting the charge generation layer, the coating liquid containing the phosphazene polyene together with an optional resin and a charge-generating substance may be applied, dried and then cured to provide the charge generation layer. The phosphazene polyene may be used in a proportion of at least 5 wt. %, preferably at least 10 wt. %, more preferably at least 20 wt. %, further preferably at least 30 wt. %, of a total of the phosphazene polyene and the resin.

In any case, the charge generation layer may preferably have a thickness of at most 5 microns, particularly 0.05–2 microns.

Examples of the charge-transporting substance may include: polycyclic aromatic compounds including a structure, such as biphenylene, anthracene, pyrene or phenanthrene in their main chain or side chain; nitrogen-containing cyclic compounds including indole, carbazole, oxadiazole and pyrazoline; hydrazone compounds, and styryl compounds.

In the present invention, it is preferred to use a charge-generating substance having an oxidation potential of at least 0.6 eV so as to minimize photodegradation.

The charge transport layer may generally be formed by applying and drying a coating liquid obtained by dissolving a charge-transporting substance as described above. In the case of using the phosphazene polyene for constituting the charge transport layer, the coating liquid is caused to contain the phosphazene polyene, and is applied, dried and then cured to provide the charge transport layer.

Examples of the binder resin suitably used for the charge transport layer may include: insulating resins, such as acrylic resin, polyarylate, polyester, polycarbonate, polystyrene, acrylonitrile-styrene copolymer, polyacrylamide, polyamide and chlorinated rubber; and organic photoconductive polymers, such as poly-N-vinylcarbazole and polyvinylanthracene.

When the phosphazene polyene is used for constituting the charge transport layer, the phosphazene polyene may be used in a proportion of at least 5 wt. %, preferably at least 10 wt. %, more preferably at least 20 wt. %, further preferably at least 30 wt. %, of a total of the phosphazene polyene and the resin.

Further, the weight ratio of the charge-transporting substance and the binder resin including the phosphazene polyene resin may preferably be in the range of 2:1–1:2.

Examples of the solvent may include: ketones, such as acetone and methyl ethyl ketone; esters, such as methyl acetate and ethyl acetate; aromatic hydrocarbons, such as toluene and xylene; and chlorinated hydrocarbons, such as chlorobenzene, chloroform and carbon tetrachloride.

The charge transport layer may further contain various types of additives, examples of which may include: diphenyl, diphenyl chloride, o-terphenyl, p-terphenyl, dibutyl phthalate, dimethyl glycol phthalate, dioctyl phthalate, triphenylphosphoric acid, methylnaphthalene, benzophenone, chlorinated paraffin, dilauryl thiopropionate, and 3,5-dinitrosalicylic acid.

The charge transport layer may preferably have a thickness of 5–40 microns, particularly 10–30 microns.

In the case of the electrophotographic photosensitive member having a single photosensitive layer, the charge-generating substance, charge-transporting substance and additional resin may be selected from those correspondingly enumerated in the case of the laminate structure photosensitive layer described above. The photosensitive layer may preferably have a thickness of 5–40 microns, particularly 10–30 microns. Again, the resin from the phosphazene polyene may constitute at least 5 wt. %, preferably at least 10 wt. %, more preferably at least 20 wt. %, further preferably at least 30 wt. %, of the total resin component.

Next, the second-type of electrophotographic photosensitive member wherein the phosphazene polyene resin is used to constitute a protective layer will now be described.

In an electrophotographic photosensitive member, as described above, a protective layer may be disposed on a photosensitive layer in order to provide an improved durability. The phosphazene polyene resin according to the present invention may preferably be used to also constitute such a protective layer.

In this instance, the photosensitive layer may be of any type but it is very effective to dispose such a protective layer on a laminate-type photosensitive layer, particularly one having a charge generation layer, which is generally very thin, as an upper layer.

Further, in the case of a laminate-type photosensitive member having a charge generation layer, a charge transport layer and a protective layer of the phosphazene polyene resin disposed in this order on an electroconductive support, the protective layer may be penetrated with the charge-transporting substance in the charge transport layer so as to provide a further decrease in residual potential and a higher sensitivity without losing the function of the protective layer. The penetration of the protective layer with the charge-transporting substance may be effected in various ways, e.g., by using a substance capable of dissolving the charge-transporting substance as a solvent for the protective layer-forming coating liquid, or by drying of the protective layer after coating at a temperature above the glass transition temperature of the binder resin constituting the charge transport layer.

The phosphazene polyene resin according to the present invention may preferably be used in a proportion of 15–100 wt. %, particularly 30–100 wt. %, of the total resin constituting the protective layer. The protective layer may preferably have a thickness of 0.1 micron–5 microns, particularly 0.2 micron–3 microns.

The protective layer may be formed by applying a coating liquid comprising the phosphazene polyene and an appropriate solvent, followed by drying and curing under application of light or heat.

A protective layer of an electrophotographic photosensitive member may preferably have a controlled resistivity in view of the sensitivity and charging characteristic, and the control of the resistivity may be performed, e.g., by dispersing metal or metal oxide particles in the protective layer.

In case where particles ace dispersed in a protective layer of an electrophotographic photosensitive member, it is generally necessary that the particles have a size sufficiently smaller than the wavelength of exposure light so as to prevent the scattering of the exposure light. In order to provide a uniform conductivity, it is necessary to uniformly disperse small electroconductive particles. For these reasons, the electroconductive particles may preferably have a number-average primary particle size of at most 1000 Å, particularly at most 600 Å, before the dispersion.

Accordingly, the resin used for constituting the protective layer is required to have a good ability of dispersing fine particles therein and also an ability of preventing the dispersed particles from agglomerating to form secondary particles to the utmost.

The phosphazene polyene used in the present invention has six (6) ethylenically unsaturated groups and has a relatively high polarity, so that the monomer shows a good ability of dispersing particles and can sufficiently uniformly disperse such ultra fine electroconductive particles as described above. As a result, the paint dispersion is stable for a long period, and the protective layer formed by applying, drying and curing the paint may be provided with an extremely high transparency and an extremely uniform electroconductivity.

Examples of metal oxide particles suitably used in the protective layer may include fine particles of metal oxide, such as zinc oxide, titanium oxide, tin oxide, antimony oxide, indium oxide, bismuth oxide, tin oxide-containing titanium oxide, tin-containing indium oxide, antimony-containing tin oxide and zirconium oxide. These metal oxides may be used singly or in mixture of two or more species. When two or more species of metal oxides are used, they can assume a form of solid solution or agglomerate.

The metal or metal oxide particles may preferably be contained in a proportion of 5–90 wt. %, further preferably 10–80 wt. %, of the protective layer.

In the present invention, it is possible to incorporate a coupling agent in the coating liquid for the protective layer so as to further improve the dispersibility, adhesion, durability and environmental stability of the protective layer.

The coupling agent used for this purpose may for example be titanium coupling agent, silane coupling agent, fluorine-containing coupling agent or aluminum-type coupling agent. It is however preferred to use titanium coupling agent or silane coupling agent, particularly titanium coupling agent because it has a long chain and many functional groups.

Examples of the titanate coupling agent may include: isopropyl triisostearyl titanate, isopropyl tridodecylbenzenesulfonyl titanate, tetraisopropyl-bis (dioctylphosphite) titanate, tetraoctylbis(ditridecylphosphite) titanate, tetra(2,2-diallyloxymethyl-1-butyl)bis(ditridecyl)phosphite titanate, bis(dioctylpyrophosphate)ethylene titanate, dicumylphenyloxyacetate titanate, and diisostearylethylene titanate.

Examples of the silane coupling agent may include: vinyltriethoxysilane, α-methacryloxypropyltrimethoxysilane, α-aminopropyltriethoxysilane, β-3,4-epoxycyclohexyltrimethoxysilane, Γ-glycidoxypropyltrimethoxysilane, and Γ-mercaptopropyltrimethoxysilane.

Such a coupling agent has both a hydrophilic group and a hydrophobic group so that it shows affinity to both inorganic electroconductive particles and the binder resin to provide remarkable effects in improving the dispersibility and adhesiveness. The coupling agent further shows an effect of preventing decrease in chargeability and sensitivity irregularity due to $O_3$ or $NO_x$ to provide an improved durability.

The coupling agent may be added in a proportion of 0.001–10 wt. %, preferably 0.005–5 wt. %, more preferably 0.01–1 wt. %, further preferably 0.05–0.5 wt. %, of the total resin constituting the protective layer.

In a specific example for evaluating dispersibility of electroconductive particles, several lots of tin oxide particles having different primary particle sizes each in an amount of 30 wt. parts were respectively mixed with 60 wt. parts of a phosphazene polyene represented by the following structural formula and 300 wt. parts of toluene, and the mixture was subjected to dispersion in a sand mill for 48 hours.

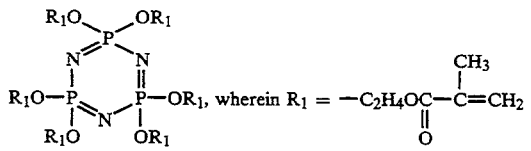

Table 1 appearing hereinbelow shows the particle sizes of the tin oxide particles with respect to the following items:

(1) Average primary particle size before the dispersion by measuring the particle sizes of 100 tin oxide particles before the dispersion having a particle size of 50 Å or larger taken at random by observation through an electron microscope (TEM) at a magnification of $2\times10^5$ and taking an average of the measured values;

(2) Average particle size of the tin oxide particles within the liquid dispersion immediately after the dispersion; and (3) Average particle size of the tin oxide particles in the liquid dispersion after one month of standing after the dispersion.

The average particle sizes in the items of (2) and (3) above were measured by a particle size-measuring apparatus ("Horiba CAPA-700" having a lower detection limit of 300 Å, available from Horiba Seisakusho K.K.)

Further, a similar dispersibility test was performed by using somewhat different lots of tin oxide particles and further incorporating 0.06 wt. part of isopropyl triisostearoyl titanate in the dispersion liquid. The results are shown in Table 2 hereinbelow.

TABLE 1

| Average particle size of tin oxide (Å) | | |
|---|---|---|
| Primary particles before dispersion | Particles within liquid dispersion | |
| | Immediately after dispersion | One month after dispersion |
| 300 | 300 | 300 |
| 500 | 600 | 700 |
| 1000 | 1200 | 1300 |
| 2000 | 2400 | 3700 |

TABLE 2

| Average particle size of tin oxide (Å) | | |
|---|---|---|
| Primary particles before dispersion | Particles within liquid dispersion | |
| | Immediately after dispersion | One month after dispersion |
| 400 | 400 | 400 |
| 800 | 900 | 900 |
| 1000 | 1100 | 1100 |
| 2000 | 2200 | 3400 |

As is clear from the above results, it is possible to provide a dispersion showing a particle size after the dispersion which is close to the primary particle size before the dispersion and which does not remarkably change with lapse of time, thus showing a good ability of dispersing fine particles.

In the present invention, it is possible to dispose an intermediate layer showing a barrier function and an adhesive function between the protective layer and the photosensitive layer.

The intermediate layer may be formed from, e.g., polyamide, nylon, polyurethane, polyester, polyvinyl alcohol or polystyrene in a thickness of 0.1 micron–5 microns, preferably 0.2 micron–3 microns.

The electroconductive support used in the present invention may be formed from any material having an electroconductivity inclusive of metals, such as aluminum, copper, chromium, nickel, zinc and stainless steel; plastic film coated with a metal foil of, e.g., aluminum and copper; plastic film coated with a vapor-deposited layer of, e.g., aluminum, indium oxide or tin oxide; and sheets of metal, plastic or paper coated with an electroconductive layer formed by application of an electroconductive substance together with an appropriate binder resin.

Examples of such an electroconductive substance constituting an electroconductive layer may include: particles of metals, such as aluminum, copper, nickel, and silver; foil and short fibers of metals; particles of electroconductive metal oxides, such as antimony oxide, indium oxide and tin oxide; electroconductive polymers, such as polypyrrole, polyaniline, and polymeric electrolytes; carbon fiber, carbon black and graphite powder; organic and inorganic electrolytes; and particles coated with an electroconductive substance as described above.

Examples of the binder resin for the electroconductive layer may include: polyvinyl alkyl ether, alkylcellulose, casein, gelatin, polyester, polyamide, polyalkylene oxide, polyamino acid ester, polycarbonate, poly(meth)acrylate acid ester, poly(meth)acrylamide, polyvinyl formal, polyurethane, phenolic resin, and epoxy resin.

The electroconductive layer may have a thickness on the order of 0.5 micron–30 microns, which may be determined based on the degree of defects or scars on the support and required electrophotographic performance.

The electroconductive support may assume an arbitrary shape, such as a drum, a sheet or a belt selected corresponding to an electrophotographic apparatus using the photosensitive member.

In the present invention, it is also possible to dispose an undercoating layer showing a barrier function or adhesive function between the electroconductive support or electroconductive layer and the photosensitive layer or dielectric layer. The undercoating layer may be formed by a material, such as casein, polyvinyl alcohol, alcohol-soluble polyamide, polyurethane, nylon, gelatin and aluminum oxide. The undercoating layer may preferably have a thickness of 0.1–5 microns, further preferably 0.2–2 microns.

The above-mentioned various layers may be respectively formed by applying the respective coating liquids or paints containing an appropriate solvent by appropriate coating methods, such as dipping, spraying, beam coating, spinner coating, roller coating, wire bar coating, and blade coating, and drying the applied layer.

The electrophotographic photosensitive member according to the present invention may be generally applicable to electrophotographic apparatus, such as copying machines, laser beam printers, LED printers, and LC-shutter printers, and also various apparatus, such as those for display, recording, small-scale printing, plate-production and facsimile communication.

FIG. 1 shows a schematic structural view of an ordinary transfer-type electrophotographic apparatus using an electrophotosensitive member of the invention. Referring to FIG. 1, a photosensitive drum (i.e., photosensitive member) 1 as an image-carrying member is rotated about an axis 1*a* at a prescribed peripheral speed in the direction of the arrow shown inside of the photosensitive drum 1. The surface of the photosensitive drum is uniformly charged by means of a charger 2 to have a prescribed positive or negative potential. The photosensitive drum 1 is exposed to light-image L (as by slit exposure or laser beam-scanning exposure) by using an image exposure means (not shown), whereby an electrostatic latent image corresponding to an exposure image is successively formed on the surface of the photosensitive drum 1. The electrostatic latent image is developed by a developing means 4 to form a toner image. The toner image is successively transferred to a transfer material P which is supplied from a supply part (not shown) to a position between the photosensitive drum 1 and a transfer charger 5 in synchronism with the rotating speed of the photosensitive drum 1, by means of the transfer charger 5. The transfer material P with the toner image thereon is separated from the photosensitive drum 1 to be conveyed to a fixing device 8, followed by image fixing to print out the transfer material P as a copy outside the electrophotographic apparatus. Residual toner particles on the surface of the photosensitive drum 1 after the transfer are removed by means of a cleaner 6 to provide a cleaned surface, and residual charge on the surface of the photosensitive drum 1 is erased by a pre-exposure means 7 to prepare for the next cycle. As the charger 2 for charging the photosensitive drum 1 uniformly, a corona charger is widely used in general. As the transfer charger 5, such a corona charger is also widely used in general.

According to the present invention, in the electrophotographic apparatus, it is possible to provide a device unit which includes plural means inclusive of or selected from the photosensitive member (photosensitive drum), the charger, the developing means, the cleaner, etc. so as to be attached or released as desired. The device unit may, for example, be composed of the photosensitive member and at least one device of the charger, the developing means and the cleaner to prepare a single unit capable of being attached to or released from the body of the electrophotographic apparatus by using a guiding means such as a rail in the body. The device unit can be accompanied with the charger and/or the developing means to prepare a single unit.

In a case where the electrophotographic apparatus is used as a copying machine or a printer, exposure light-image L may be provided by reading data from reflected light or transmitted light from an original or on the original, converting the data into a signal and then effecting a laser beam scanning, a drive of LED array or a drive of a liquid crystal shutter array.

Figure 2:
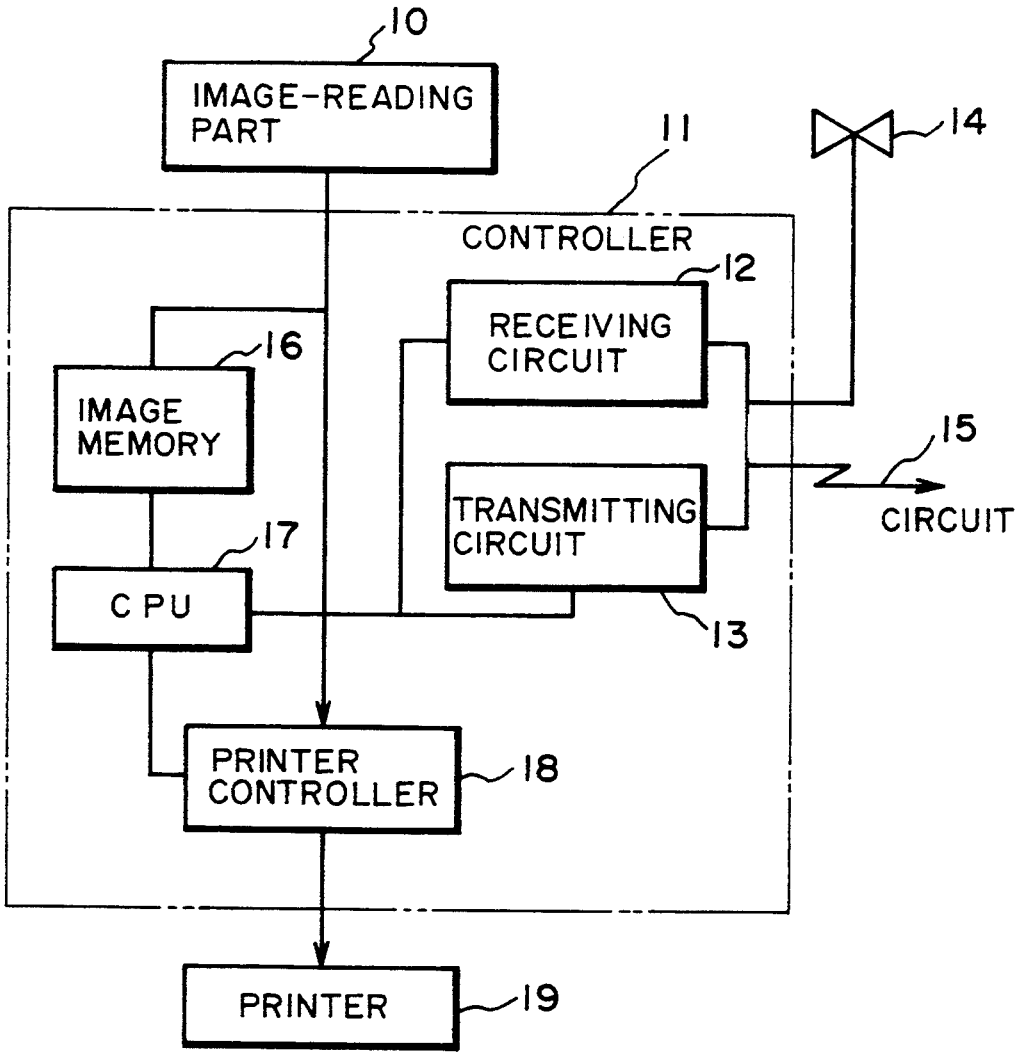
FIG. 2 is a block diagram of a facsimile apparatus including such an electrophotographic apparatus as a printer.

In a case where the electrophotographic apparatus according to the present invention is used as a printer of a facsimile machine, exposure light-image L is given by exposure for printing received data. FIG. 2 shows a block diagram of an embodiment for explaining this case. Referring to FIG. 2, a controller 11 controls an image-reading part 10 and a printer 19. The whole controller 11 is controlled by a CPU (central processing unit) 17. Read data from the image-reading part is transmitted to a partner station through a transmitting circuit 13, and on the other hand, the received data from the partner station is sent to the printer 19 through a receiving circuit 12. An image memory memorizes prescribed image data. A printer controller 18 controls the printer 19, and a reference numeral 14 denotes a telephone handset.

The image received through a circuit 15 (the image data sent through the circuit from a connected remote terminal) is demodulated by means of the receiving circuit 12 and successively stored in an image memory 16 after a restoring-signal processing of the image data. When image for at least one page is stored in the image memory 16, image recording of the page is effected. The CPU 17 reads out the image data for one page from the image memory 16 and sends the image data for one page subjected to the restoring-signal processing to the printer controller 18. The printer controller 18 receives the image data for one page from the CPU 17 and controls the printer 19 in order to effect image-data recording. Further, the CPU 17 is caused to receive image data for a subsequent page during the recording by the printer 19. As described above, the receiving and recording of the image are performed.

Hereinbelow, the present invention will be explained based on Examples wherein "part(s)" means "part(s) by weight" unless otherwise indicated specifically.

Example 1

50 parts of electroconductive titanium oxide powder coated with tin oxide containing 10%-antimony oxide, 25 parts of a phenolic resin ("Pli-O-Phen J-325", mfd. by Dai-Nippon Ink K.K.), 20 parts of methyl cellosolve, 5 parts of methanol and 0.002 part of silicone oil (polydimethylsiloxane-polyoxyalkylene copolymer, Mn (number-average molecular weight)=3000) were mixed and dispersed with each other in a sand mill apparatus using 1 mm-dia. glass beads for 2 hours to obtain an electroconductive paint.

An aluminum cylinder (30 mm-dia. ×260 mm-long) was coated by dipping with the above-prepared paint, followed by 30 minutes of drying at 140° C., to form a 20 micron-thick electroconductive layer.

Separately, 10 parts of an alcohol-soluble copolymer nylon resin (Mw (weight-average molecular weight)=29000) and 30 parts of methoxymethylated 6-nylon resin (Mw=32000) were dissolved in a mixture solvent of 260 parts of methanol and 40 parts of butanol. The thus-formed mixture solution was applied by dipping onto the above-prepared electroconductive layer and dried for 10 min. at 90° C. to form a 1 micron-thick undercoating layer.

Then, 10 parts of a styryl compound of the formula shown below and 10 parts of polycarbonate Z (Mw=46000) were dissolved in a mixture solvent of 20 parts of dichloromethane and 40 parts of monochlorobenzene. The resultant solution was applied by dipping onto the undercoating layer, followed by 60 min. of drying at 120° C. to form a 18 micron-thick charge transport layer.

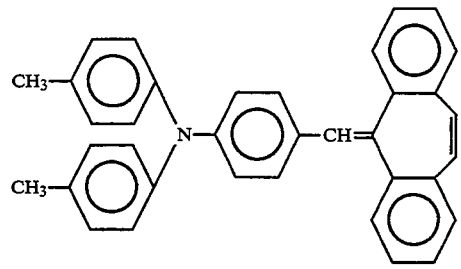

Separately, 4 parts of a disazo pigment of the formula below, 8 parts of polyvinyl butyral (butyral degree=68%, Mw=24000) and 34 parts of cyclohexanone were dispersed for 12 hours in a sand mill using 100 parts of 1 mm-dia. glass beads. The resultant dispersion was diluted with 60 parts of tetrahydrofuran (THF) to form a liquid dispersion for a charge generation layer. The liquid dispersion was applied by spraying onto the charge transport layer, followed by 15 min. of drying at 80° C. to form a 0.15 micron-thick charge generation layer.

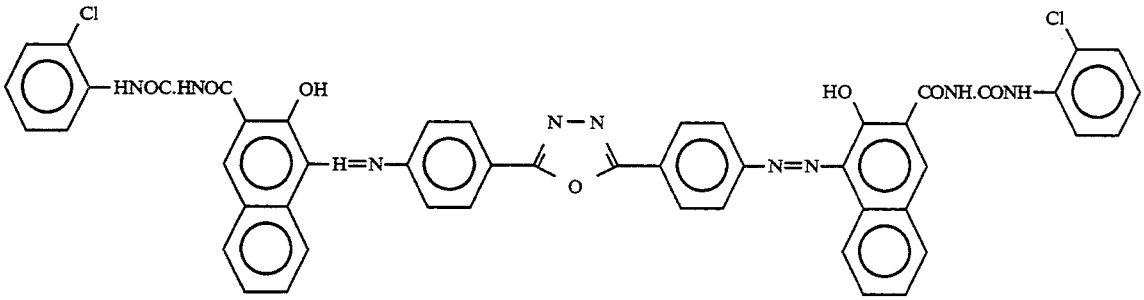

Then, a coating liquid identical to the one for the undercoaing layer was applied by spraying onto the charge generation layer to form a 1 micron-thick intermediate layer.

Separately, 60 parts of a phosphazene polyene represented by the formula (I) wherein $R_1$ was $—C_2H_4OCO—C(CH_3)=CH_2$ (hereinafter called "Monomer 1"), 30 parts of antimony-containing tin oxide particles, 0.06 part of isopropyl triisostearoyl titanate, 0.12 part of 2-methylthioxanthone and 300 parts of toluene were subjected to 48 hours of dispersion.

The average primary particle size of the antimony-containing tin oxide particles was 500 Å.

The resultant coating liquid was applied in the form of a beam (i.e., by beam coating) onto the above-prepared intermediate layer to form a layer, which was then dried and then subjected to photocuring for 20 seconds at a photo-intensity of 8 mW/cm$^2$ from a high-voltage, mercury lamp to form a 4 micron-thick protective layer.

The dispersibility of the liquid dispersion for the protective layer was good, and the resultant protective layer had a uniform surface free of irregularity. Incidentally, the average particle size of the antimony-containing tin oxide particles in the liquid dispersion was also 500 Å.

The thus-prepared electrophotographic photosensitive member was positively charged by corona discharge at +5 KV by using an electrostatic copying paper tester ("Model SP-428", mfd. by Kawaguchi Denki K.K.), then held for 1 second in a dark place and exposed for 10 seconds at an illuminance of 2 lux. from a halogen lamp, whereby the charging characteristics of the electrophotographic photosensitive member were evaluated.

The evaluated charging characteristics included a surface potential (dark-part potential) after the charging, a sensitivity in terms of an exposure quantity required for reducing the surface potential from 700V to 200V, and a residual potential after the 10 seconds of the exposure.

Further, the electrophotographic photosensitive member was incorporated in an electrophotographic copying apparatus of the normal development-type for repeating a 1.5 sec-process cycle including the steps of charging-exposure-development-transfer-cleaning and subjected to a durability test by $10^5$ sheets of repetitive image-formation.

The images before and after the durability test were evaluated by naked eyes. The results are shown in Table 3 appearing hereinafter together with the results of other examples.

Examples 2–4

Photosensitive members were prepared and evaluated in the same manner as in Example 1 except that the average primary particle size and content of the antimony-containing tin oxide particles and the coupling agent and content thereof in the protective layer were respectively changed as shown in Table 3. The results are also shown in Table 3.

Example 5

An aluminum cylinder was coated with an electroconductive layer and an undercoating layer in the same manner as in Example 1.

Then, 10 parts of a charge transporting substance of the formula shown below and 10 parts of polycarbonate Z (Mw=25000) were dissolved in a mixture solvent of 20 parts of dichloromethane and 40 parts of monochlorobenzene, and the resultant solution was applied by dipping onto the above-prepared undercoating layer, followed by 60 minutes of drying at 120° C. to form a 15 micron-thick charge transport layer.

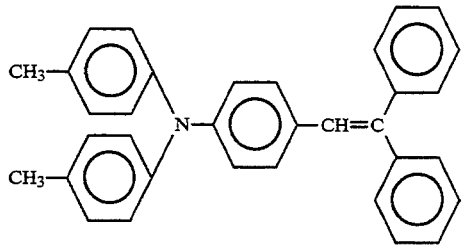

Separately, 4 parts of a disazo pigment of the formula shown below, 2 parts of polyvinyl benzal (benzal degree=80%, Mw=11000) and 30 parts of cyclohexanone were dispersed for 20 hours in a sand mill using 1 mm-dia. glass beads, and then diluted with 60 parts of methyl ethyl ketone to form a liquid dispersion for a charge generation layer. The liquid dispersion was applied by spraying onto the above-prepared charge transport layer and dried for 15 minutes at 80° C. to form a 0.10 micron-thick charge generation layer.

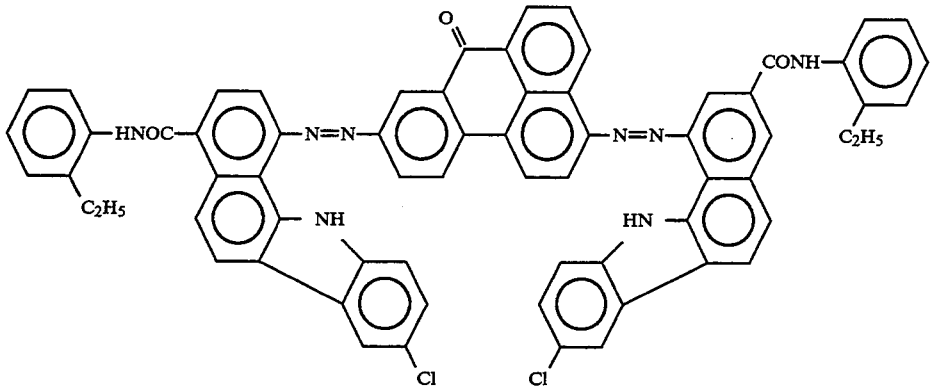

Then, a 1 micron-thick intermediate layer was formed on the charge generation layer in the same manner as in Example 1.

Separately, 90 parts of a phosphazene polyene represented by the formula (I) wherein $R_1$ was —$CH_2OCO$—$C(CH_3)=CH_2$ (hereinafter called "Monomer 2"), 30 parts of antimony-containing tin oxide particles having an average primary particle size of 400 Å, 0.03 part of diisostearoylethylene titanate, 0.06 part of benzophenone as a photo-initiator and 300 parts of toluene were subjected to 48 hours of dispersion.

The resultant coating liquid was applied by beam coating onto the above-prepared intermediate layer to form a layer, which was then dried and then subjected to photocuring for 30 seconds at a photointensity of 8 $mW/cm^2$ from a high-voltage, mercury lamp to form a 4.5 micron-thick protective layer.

The dispersibility of the liquid dispersion for the protective layer was good, and the resultant protective layer had a uniform surface free of irregularity. The average particle size of the antimony-containing tin oxide particles in the liquid dispersion was also 400 Å.

The thus prepared photosensitive member was evaluated in the same manner as in Example 1. The results are also shown in Table 3.

Example 6

A photosensitive member was prepared and evaluated in the same manner as in Example 5 except that, for the preparation of the protective layer, the phosphazene polyene was replaced by one of the formula (I) wherein $R_1$ was

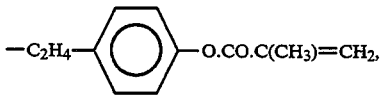

(Monomer 3)

and the content of the coupling agent was changed as shown in Table 3. The results are also shown in Table 3.

Example 7

A photosensitive member was prepared and evaluated in the same manner as in Example 5, except that the average primary particle size, the coupling agent and the content thereof in the protective layer were changed as shown in Table 3. The results are also shown in Table 3.

Example 8

A photosensitive member having an electroconductive layer, an undercoating layer, a charge generation layer, a charge transport layer, an intermediate layer and a protective layer disposed in this order on an aluminum cylinder, was prepared in the same manner as in Example 1 except that the order of the formation of the charge transport layer and the charge generation layer was reversed from that in Example 1.

The thus prepared photosensitive member was evaluated in a similar manner as in Example 1 except that the photosensitive member was first charged negatively. The results are also shown in Table 3.

TABLE 3

| | Protective layer | | | | | Electrophotographic characteristics | | |
|---|---|---|---|---|---|---|---|---|
| | | Conductive particles | | Coupling agent | | | | |
| Example | Monomer | Primary particle size (Å) | Content (wt. %) | Compound name* | Content (ppm) | Dark-part potential (V) | Sensitivity (lux · sec) | Residual potential (V) |
| 1 | 1 | 500 | 33 | ITT | 1000 | 900 | 2.1 | 25 |
| 2 | 1 | 400 | 33 | ITT | 500 | 870 | 1.9 | 30 |
| 3 | 1 | 500 | 66 | ITBST | 400 | 885 | 1.8 | 25 |
| 4 | 1 | 400 | 33 | VTS | 400 | 880 | 2.3 | 40 |
| 5 | 2 | 400 | 25 | DET | 500 | 920 | 1.7 | 20 |
| 6 | 3 | 400 | 25 | DET | 300 | 870 | 2.1 | 25 |
| 7 | 3 | 500 | 25 | γ-ATS | 1000 | 865 | 2.4 | 45 |
| 8 | 1 | 500 | 33 | ITT | 1000 | −890 | 2.0 | −25 |

| | Image evaluation | | | |
|---|---|---|---|---|
| | Before durability | After durability test of | | |
| | | $2 \times 10^4$ | $5 \times 10^4$ | $10^5$ |

TABLE 3-continued

| | test | sheets | sheets | sheets |
|---|---|---|---|---|
| 1 | Excellent | Excellent | Excellent | Excellent |
| 2 | " | " | " | " |
| 3 | " | " | " | " |
| 4 | " | " | " | " |
| 5 | " | " | " | " |
| 6 | " | " | " | " |
| 7 | " | " | " | " |
| 8 | " | " | " | " |

*ITT: isopropyl triisostearoyl titanate
ITBST: isopropyl tridodecylbenzenesulfonyl titanate
VTS: vinyltriethoxysilane
DET: diisostearoylethylene titanate
γ-ATS: γ-aminopropyltriethoxysilane Example 9

An electroconductive support was successively coated with an electroconductive layer, an undercoating layer, a charge transport layer, a charge generation layer and an intermediate layer in the same manner as in Example 1.

Then, 4 parts of Monomer 1 used in Example 1, 0.02 part of 1-hydroxycyclohexyl phenyl ketone, 2.5 parts of antimony-containing tin oxide particles and 60 parts of toluene were subjected to 12 hours of dispersion and then diluted with 60 parts of methyl ethyl ketone. The antimony-containing tin oxide particles showed an average primary particle size of 400 Å. The resulting coating liquid was applied by spraying onto the above-prepared intermediate layer, dried at 120° C. for 30 min., and cured under irradiation for 30 seconds with ultraviolet rays from a 1.5 kV-high voltage mercury lamp disposed 25 cm apart while rotating the cylindrical support at 20 rpm, thereby to form a 2 micron-thick protective layer.

The thus prepared electrophotographic photosensitive member was evaluated in the same manner as in Example 1. The results are shown in Table 4 appearing hereinafter together with the results of other Examples.

Example 10

A photosensitive member was prepared and evaluated in the same manner as in Example 9 except that the phosphazene polyene for the protective layer was replaced by Monomer 2 used in Example 5. The results are also shown in Table 4.

Example 11

A photosensitive member was prepared and evaluated in the same manner as in Example 9 except that the antimony-containing tin oxide particles were replaced by tin-containing indium oxide particles, which showed an average primary particle size of 500 Å.

The results are also shown in Table 4.

Example 12

An intermediate structure of the photosensitive member up to the intermediate layer was prepared in the same manner as in Example 1.

Separately, 2 parts of polycarbonate resin (Mw=46000) was dissolved in 60 parts of toluene, and 2 parts of Monomer 1 used in Example 9, 0.01 part of 1hydroxycyclohexyl phenyl ketone and 2.5 parts of antimony-containing zinc oxide particles having an average primary particle size of 300 Å were added thereto. Then, the resulting mixture was subjected to dispersion by means of a sand mill using glass beads for 15 hours, and then diluted with 60 parts of methyl ethyl ketone. The average particle size of the antimony-containing zinc oxide particles in the dispersion was 400 Å.

The liquid dispersion was used as a coating liquid in the same manner as in Example 9 to prepare a protective layer. The thus-prepared photosensitive member was evaluated in the same manner as in Example 9.

The results are also shown in Table 4.

TABLE 4

| | Protective layer | | | Electrophotographic characteristics | | | Image evaulation in durability test | | | |
|---|---|---|---|---|---|---|---|---|---|---|
| | | Conductive particles | | | | | | | | |
| Example | Resin component | Name* | Primary particle size (Å) | Dark-part potential (V) | Sensitivity (lux · sec) | Residual potential (V) | Initial stage | After $2 \times 10^4$ sheets | After $5 \times 10^4$ sheets | After $10^5$ sheets |
| 9 | Monomer 1 | ATO | 400 | 950 | 2.0 | 30 | Excellent | Excellent | Excellent | Good |
| 10 | Monomer 2 | ATO | 400 | 970 | 2.1 | 35 | " | " | " | " |
| 11 | Monomer 1 | TIO | 500 | 945 | 2.1 | 35 | " | " | " | " |
| 12 | Monomer 1 + poly-carbonate | AZO | 300 | 950 | 2.2 | 35 | " | " | " | Fair |

*ATO: antimony-containing tin oxide
TIO: tin-containing indium oxide
AZO: antimony-containing zinc oxide Example 13

An aluminum cylinder was coated with an electroconductive layer and an undercoating layer in the same manner as in Example 1.

Separately, 4 parts of a disazo pigment of the formula below, 8 parts of polyvinyl butyral (butyral degree=68%, Mw=24000) and 34 parts of cyclohexanone were dispersed for 12 hours in a sand mill using 1 mm-dia. glass beads. The resultant dispersion was diluted with 200 parts of cyclohexanone and 200 parts of tetrahydrofuran (THF) to form a liquid dispersion for a charge generation layer. The liquid dispersion was applied by dipping onto the undercoating layer, followed by 30 min. of drying at 120° C., to form a 0.15 micron-thick charge generation layer.

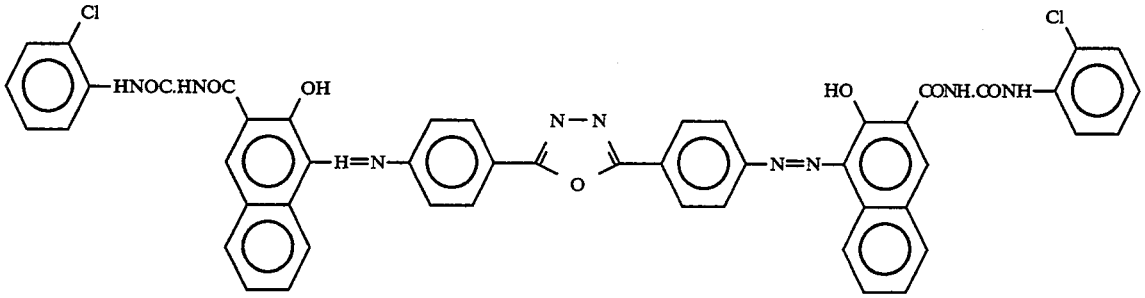

Then, 10 parts of a styryl compound of the formula shown below and 10 parts of polycarbonate (Mw=46000) were dissolved in a mixture solvent of 20 parts of dichloromethane and 40 parts of monochlorobenzene. The resultant solution was applied by dipping onto the charge generation layer, followed by 30 min. of drying at 120° C. to form a 18 micron-thick charge transport layer.

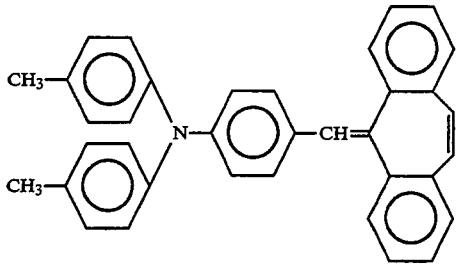

Then, 8 parts of Monomer 1 used in Example 1, 0.1 part of 1-hydroxycyclohexyl phenyl ketone, 60 parts of toluene and 60 parts of methyl ethyl ketone were dissolved with each other to form a coating liquid. The coating liquid was applied by spraying onto the above-prepared charge transport layer, dried at 120° C. for 30 min., and cured under irradiation for 30 seconds with ultraviolet rays from a 2 kV-high voltage mercury lamp disposed 25 cm apart while rotating the cylindrical support at 10 rpm, thereby to form a 1.5 micron-thick protective layer.

The thus prepared electrophotographic photosensitive member was evaluated in the same manner as in Example 1 except that the photosensitive member was changed to a negative polarity. The results are shown in Table 5 appearing hereinafter together with the results of other Examples.

Example 14

A photosensitive member was prepared and evaluated in the same manner as in Example 13 except that the phosphazene polyene for the protective layer was replaced by Monomer 2 used in Example 5 to result in a 1.0 micron-thick protective layer. The results are also shown in Table 5.

Example 15

A photosensitive member was prepared and evaluated in the same manner as in Example 13 except that, for the preparation of the protective layer, the phosphazene polyene was replaced by one of the formula (I) wherein $R_1$ was

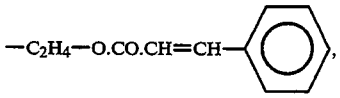

(Monomer 4)

and the ultraviolet irradiation was performed for 90 seconds, to result in a 0.3 micron-thick protective layer.

The results are also shown in Table 5.

Example 16

An intermediate structure of the photosensitive member up to the charge transport layer was prepared in the same manner as in Example 13.

Separately, 3 parts of polycarbonate resin (Mw=35,000) was dissolved in 60 parts of toluene, and 3 parts of Monomer 2 used in Example 14 and 0.015 part of 1-hydroxycyclohexyl phenyl ketone were added thereto. The resultant coating liquid was applied onto the above-prepared charge transport layer, dried and cured in the same manner as in Example 13 to result in a 2.0 micron-thick protective layer.

The thus prepared photosensitive member was evaluated in the same manner as in Example 13. The results are also shown in Table 5.

Example 17

An intermediate structure of a photosensitive member having an electroconductive layer, an undercoating layer, a charge transport layer and a charge generation layer disposed in this order on an aluminum cylinder was prepared in the same manner as in Example 13 except that the order of the formation of the charge generation layer and the charge transport layer was reversed from that in Example 13.

Separately, 2 parts of alcohol-soluble copolymer nylon resin (Mw=29,000) and 6 parts of methoxymethylated 6-nylon resin (Mw=32,000) were dissolved in a mixture solvent of 200 parts of methanol and 200 parts of butanol. The resultant liquid was applied by spraying onto the charge generation layer and dried at 90° C. for 10 min. to form a 0.5 micron-thick intermediate layer, which was then coated by a protective layer formed by application, drying and curing in the same manner as in Example 13.

The thus prepared photosensitive member was evaluated in the same manner as in Example 13. The results are also shown in Table 5.

TABLE 5

| Example | Protective layer: Resin component | Protective layer: Thickness (μm) | Electrophotographic characteristics: Dark-part potential (V) | Electrophotographic characteristics: Sensitivity (lux · sec) | Electrophotographic characteristics: Residual potential (V) | Image evaluation in durability test: Initial stage | After $2 \times 10^4$ sheets | After $5 \times 10^4$ sheets | After $10^5$ sheets |
|---|---|---|---|---|---|---|---|---|---|
| 13 | Monomer 1 | 1.5 | −960 | 2.0 | −30 | Excellent | Excellent | Good | Fair |
| 14 | Monomer 2 | 1.0 | −950 | 2.1 | −35 | " | " | " | " |
| 15 | Monomer 4 | 0.3 | −945 | 2.8 | −40 | " | " | " | " |
| 16 | Poly-carbonate + Monomer 2 | 2.0 | −970 | 2.2 | −30 | " | " | Fair | " |
| 17 | Monomer 1 | 1.5 | 950 | 1.9 | 30 | " | " | Good | " |

Comparative Example 1

A photosensitive member was prepared and evaluated in the same manner as in Example 13 except that the surface protective layer was omitted.

The results are shown in Table 6 appearing hereinafter together with the results of other Comparative Examples.

Comparative Example 2

A photosensitive member was prepared in the same manner as in Example 13 except that the protective layer was replaced by one prepared in the following manner.

Thus, 7 parts of polycarbonate Z resin (Mw=46,000) was dissolved in 60 parts of toluene and 60 parts of methyl ethyl ketone. The resultant coating liquid was applied by spraying onto the charge transport layer and dried at 120° C. for 60 min. to form a 2 micron-thick protective layer.

The thus-prepared photosensitive member was evaluated in the same manner as in Example 13. The results are also shown in Table 6.

Comparative Example 3

A photosensitive member was prepared and evaluated in the same manner as in Example 13 except that the protective layer was prepared by using a photocurable resin ("Three Bond 3070", available from Three Bond K.K.) as described in JP-A 63-48564.

The results are also shown in Table 6.

Comparative Example 4

A photosensitive member was prepared and evaluated in the same manner as in Example 13 except that the protective layer was prepared by using a thermosetting resin ("Dianal HR 620", available from Mitsubishi Rayon K.K.) as described in JP-A 61-5253.

The results are also shown in Table 6.

TABLE 6

| Comp. Example | Protective layer: Resin component | Protective layer: Thickness (μm) | Electrophotographic characteristics: Dark-part potential (V) | Electrophotographic characteristics: Sensitivity (lux · sec) | Electrophotographic characteristics: Residual potential (V) | Image evaluation in durability test: Initial stage | After $2 \times 10^4$ sheets | After $5 \times 10^4$ sheets | After $10^5$ sheets |
|---|---|---|---|---|---|---|---|---|---|
| 1 | — | — | −870 | 1.9 | −20 | Excellent | Not accept-able*1 | — | — |
| 2 | Poly-carbonate Z | 2.0 | −930 | 3.0 | −95 | Ground fog | Not accept-able*2 | — | — |
| 3 | Trhee Bond 3070 | 1.5 | −920 | 3.6 | −70 | Good | Fair | Not accept-able*2 | — |
| 4 | Dianal HR 620 | 1.5 | −900 | 3.2 | −65 | Good | Fair | Not accept-able*2 | — |

*1: Image defects occurred at 300 sheets.
*2: Scars were observed due to remarkable abrasion.

Example 18

An aluminum cylinder was coated with an electroconductive layer, an undercoating layer and a charge generation layer in the same manner as in Example 13.

Then, 10 parts of a styryl compound of the structural formula shown below having an oxidation potential of 0.81 eV, 10 parts of polycarbonate Z (Mw=46,000), 3 parts of Monomer 2 used in Example 5 and 0.5 part of 1-hydroxycyclohexyl phenyl ketone were dissolved in a mixture solvent of 20 parts of dichloromethane and 40 parts of monochlorobenzene.

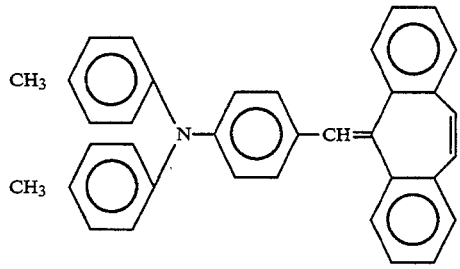

The resultant coating liquid was applied by dipping onto the above-prepared charge generation layer, dried at 120° C. for 30 min., and then cured by irradiation for 30 seconds with ultraviolet rays from a 1.5 kV-high voltage mercury lamp disposed 25 cm apart to form a 18 micron-thick charge transport layer.

The thus-prepared photosensitive member was evaluated in the same manner as in Example 13. The results are shown in Table 7 appearing hereinafter together with the results of other Examples.

Example 19

A coating liquid was prepared by dispersing 4 g of oxytitanium-phthalocyanine prepared according to a production example disclosed in U.S. Pat. No. 4,728,592 (JP-A 61-239248) together with a solution of 3 g of polyvinyl butyral (butyral degree=68 mol. %, Mw=35,000) in 95 ml of cyclohexanone in a sand mill for 20 hours.

The coating liquid after dilution was applied by dipping onto an aluminum cylinder and dried to form a 0.1 micron-thick charge generation layer.

Then, 10 parts of a compound of the structural formula shown below having an oxidation potential of 0.76 eV, 10 parts of Monomer 1 used in Example 1 and 1 part of 1-hydroxycyclohexyl phenyl ketone were dissolved in 80 parts of monochlorobenzene.

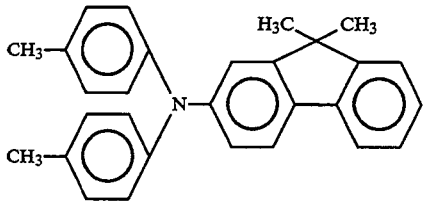

The resultant coating liquid was applied by dipping onto the above-prepared charge generation layer, dried and cured in the same manner as in Example 18 to form a 16 micron-thick charge transport layer.

The thus-prepared photosensitive member was evaluated in the same manner as in Example 13. The results are also shown in Table 7.

Example 20

A photosensitive member was prepared and evaluated in the same manner as in Example 18 except that Monomer 2 was replaced by a phosphazene polyene of the formula (I) wherein $R_1$ was $—CH_2—O.-CO—CH=CH_2$ (Monomer 5).

The results are also shown in Table 7.

Example 21

An aluminum cylinder was dipped in a solution of 5 g of methoxymethylated nylon resin (Mw=32,000) and 10 g of alcohol-soluble copolymer nylon resin (Mw=29,000) in 95 g of methanol and dried to form a 1 micron-thick undercoating layer.

Then, a 0.1 micron-thick charge generation layer as formed in the same manner as in Example 19.

Then, 10 parts of a hydrazone compound of the structural formula shown below having an oxidation potential of 0.67 eV, 10 parts of polymethyl methacrylate resin (Mn=105), 2 parts of a phosphazene polyene of the formula (I) wherein $R_1$ was (Monomer 6)

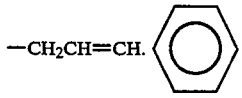

and 0.1 part of 2,4-dimethylthioxanthonone were dissolved in 80 parts of monochlorobenzene.

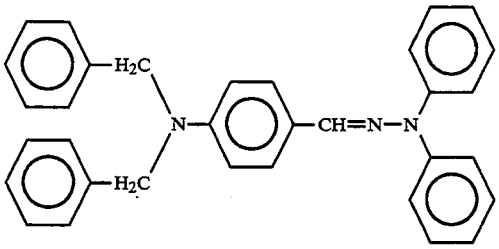

The resultant coating liquid was applied onto the above-formed charge generation layer, dried at 120° C. for 30 min. and photocured by 6 seconds of irradiation with ultraviolet rays otherwise under the same conditions as in Example 18 to form a 20 micron-thick charge transport layer.

The thus-prepared photosensitive member was evaluated in the same manner as in Example 13. The results are also shown in Table 7.

TABLE 7

| Example | Resin component in charge transport layer | Electrophotographic characteristics: Dark-part potential (−V) | Sensitivity (lux · sec) | Residual potential (V) | Image evaluation in durability test: Initial stage | After $2 \times 10^4$ sheets | After $5 \times 10^4$ sheets | After $10^5$ sheets |
|---|---|---|---|---|---|---|---|---|
| 18 | Polycarbonate Z + Monomer 2 | 900 | 2.8 | 40 | Excellent | Excellent | Good | Good |
| 19 | Monomer 1 | 910 | 3.2 | 70 | " | " | " | " |
| 10 | Polycarbonate Z + Monomer 5 | 900 | 3.0 | 30 | " | " | " | Fair |
| 21 | Polymethyl methacrylate + Monomer 6 | 900 | 3.4 | 50 | " | " | Fair | " |

Comparative Example 5

A photosensitive member was prepared and evaluated in the same manner as in Example 18 except that Monomer 2 and 1-hydroxycyclohexyl phenyl ketone were omitted from the coating liquid for the charge transport layer.

The results are shown in Table 8 appearing hereinafter together with the results of other Comparative Examples.

Comparative Example 6

A photosensitive member was prepared and evaluated in the same manner as in Example 21 except that Monomer 6 and 2,4-dimethylthioxanthone were omitted from the coating liquid for the charge transport layer.

The results are also shown in Table 8.

Comparative Example 7

A photosensitive member was prepared and evaluated in a similar manner as in Example 18 except that the photocurable resin used in Comparative Example 3 was used as the resin component for constituting the charge transport layer.

The results are also shown in Table 8.

Comparative Example 8

A photosensitive member was prepared and evaluated in a similar manner as in Example 18 except that the thermosetting resin used in Comparative Example 4 was used as the resin component for constituting the charge transport layer.

The results are also shown in Table 8.

TABLE 8

| Comp. Example | Resin component in charge transport layer | Electrophotographic characteristics: Dark-part potential (−V) | Sensitivity (lux · sec) | Residual potential (V) | Image evaluation in durability test: Initial stage | After $2 \times 10^4$ sheets | After $5 \times 10^4$ sheets | After $10^5$ sheets |
|---|---|---|---|---|---|---|---|---|
| 5 | Polycarbonate Z | 900 | 2.2 | 20 | Excellent | Not acceptable**1 | — | — |
| 6 | Polymethyl methacrylate | 890 | 3.2 | 50 | Excellent | Not acceptable**3 | — | — |
| 7 | Three Borid 3070 | 900 | 11.0 | 250 | Not acceptable**2 | — | — | — |
| 8 | Dianal HR 620 | 910 | 13.5 | 290 | Not acceptable**2 | — | — | — |

**1: Ground fog.
**2: Ground fog and low image density.
**3: Scars observed at 5000 sheets and ground fog observed at 10000 sheets.

What is claimed is:

1. An electrophotographic photosensitive member, comprising in sequence: a support, a photosensitive layer and a resinous protective layer, the resinous layer comprising a resin formed by polymerization of a compound represented by the following Formula (I):

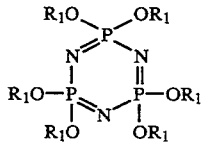

(I)

wherein $R_1$ in Formula (I) is a group represented by Formula (II) below:

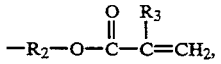

(II)

wherein $R_2$ is an alkylene group, arylene group, alkyl-substituted arylene group, alkylamide group or arylamide group, and $R_3$ is a hydrogen atom or a methyl group;

said resinous protective layer containing metal particles or metal oxide particles dispersed therein.

2. An electrophotographic photosensitive member according to claim 1, wherein said metal particles or metal oxide particles have an average primary particle size of at most 1000 Å.

3. An electrophotographic photosensitive member according to claim 2, wherein said metal particles or metal oxide particles have an average primary particle size of at most 600 Å.

4. An electrophotographic photosensitive member according to claim 1, wherein said metal oxide particles comprise particles of a metal oxide selected from the group consisting of zinc oxide, titanium oxide, tin oxide, antimony oxide, indium oxide, bismuth oxide, tin oxide-containing titanium oxide, tin-containing indium oxide, antimony-containing tin oxide and zirconium oxide.

5. An electrophotographic photosensitive member according to claim 4, wherein said metal oxide particles comprise particles of a metal oxide selected from the group consisting of tin oxide, tin-containing indium oxide and antimony-containing tin oxide.

6. An electrophotographic photosensitive member according to claim 5, wherein said metal oxide particles comprise particles of antimony-containing tin oxide.

7. An electrophotographic photosensitive member according to claim 1, wherein said protective layer contains a coupling agent.

8. An electrophotographic photosensitive member according to claim 7, wherein said coupling agent is selected from the group consisting of titanium coupling agent, silane coupling agent, fluorine-containing coupling agent and aluminum-type coupling agent.

9. An electrophotographic photosensitive member according to claim 8, wherein said coupling agent is selected from the group consisting of titanium coupling agent and silane coupling agent.

10. An electrophotographic photosensitive member according to claim 9, wherein said coupling agent is titanium coupling agent.

11. An electrophotographic photosensitive member according to claim 1, wherein said photosensitive layer has a single-layer structure.

12. An electrophotosensitive photosensitive member according to claim 1, wherein said photosensitive layer has a laminated structure including a charge generation layer and a charge transport layer.

13. An electrophotosensitive photosensitive member according to claim 12, wherein said charge transport layer is disposed closer than the charge generation layer with respect to the support.

14. An electrophotosensitive photosensitive member according to claim 12, wherein said charge transport layer is disposed farther than the charge generation layer with respect to the support.

15. An electrophotosensitive photosensitive member according to claim 14, wherein said protective layer contains a charge-transporting substance.

16. An electrophotosensitive photosensitive member according to claim 1, wherein an intermediate layer is disposed between the photosensitive layer and the protective layer.

17. An electrophotosensitive photosensitive member according to claim 1, wherein an undercoating layer is disposed between the support and the photosensitive layer.

18. An electrophotographic photosensitive member according to claim 1, wherein an electroconductive layer is disposed between the support and the photosensitive layer.

19. An electrophotographic photosensitive member according to claim 18, wherein an undercoating layer is disposed between the electroconductive layer and the photosensitive layer.

20. An electrophotographic photosensitive member according to claim 10, wherein said titanium coupling agent is selected from the group consisting of isopropyl triisostearyl titanate, isopropyl tridodecylbenzenesulfonyl titanate, tetraisopropylbis(dioctylphosphite ) titanate, tetraoctylbis(ditridecylphosphite) titanate, tetra(2,2-diallyloxymethyl-1-butyl)bis(ditridecyl)phosphite titanate, bis-dioctylpyrophosphate)ethylene titanate, dicumylphenyloxyacetate titanate and diisostearylethylene titanate.

21. An electrophotographic photosensitive member according to claim 9, wherein said coupling agent is silane coupling agent.

22. An electrophotographic photosensitive member according to claim 21, wherein said silane coupling agent is selected from the group consisting of vinyltriethoxysilane, α-methacryloxypropyltrimethoxysilane, α-aminopropyltriethoxysilane, β-3-4-epoxycyclohexyltrimethoxysilane, α-glycidoxypropyltrimethoxysilane and α-mercaptopropyltrimethoxysilane.

* * * * *

UNITED STATES PATENT AND TRADEMARK OFFICE

CERTIFICATE OF CORRECTION

PATENT NO. : 5,391,446

DATED : February 21, 1995

INVENTOR(S) : Noriko Ohtani et al.

It is certified that error appears in the above-indentified patent and that said Letters Patent is hereby corrected as shown below:

ON TITLE PAGE

In [21] Appl. No.:
"Appl. No.: 103,033" should read --Appl. No.: 724,812--.
In [56] References Cited, in second "Patent Abstracts"
"284 (P. 966)(3878)," should read --530 (P. 966)(3878)--.
In [56] References Cited, U.S. Patent Documents,
Insert "4,988,791 1/91 Maruyama et al."
In [56] References Cited, U.S. Patent Documents,
"90Chen et al." should read --Chen et al.--.
In [56] References Cited, Foreign Patent Documents,
"3065390 3/1991 Japan" should read
--3-065390 3/1991 Japan--.
In [57] ABSTRACT, Line 7:
"formida:" should read --formula:--.

COLUMN 18

Line 26, "1hydroxycyclohexyl" should read
--1-hydroxycyclohexyl--.

COLUMN 24

Line 13, "(Mn=105)," should read --(Mn=$10^5$),--.

UNITED STATES PATENT AND TRADEMARK OFFICE

CERTIFICATE OF CORRECTION

PATENT NO. : 5,391,446

DATED : February 21, 1995

INVENTOR(S) : Noriko Ohtani et al.

It is certified that error appears in the above-indentified patent and that said Letters Patent is hereby corrected as shown below:

COLUMN 25

Table 8, "Borid" should read --Bond--.

COLUMN 27

Lines 1, 5, 9, 14, 17 and 21, "electrophotosensitive" should read --electrophotographic--.

Signed and Sealed this

Thirteenth Day of June, 1995

Bruce Lehman

*Attest:*

BRUCE LEHMAN

*Attesting Officer*

*Commissioner of Patents and Trademarks*

--